US005257505A

United States Patent [19]

Butts

[11] Patent Number: 5,257,505

[45] Date of Patent: Nov. 2, 1993

[54] HIGH EFFICIENCY NITROGEN REJECTION UNIT

[76] Inventor: Rayburn C. Butts, 2500 N. Big Spring, Ste. 230, Midland, Tex. 79705

[21] Appl. No.: 932,867

[22] Filed: Aug. 20, 1992

Related U.S. Application Data

[63] Continuation-in-part of Ser. No. 682,287, Apr. 9, 1991, Pat. No. 5,141,544.

[51] Int. Cl.[5] ..... F25J 3/02

[52] U.S. Cl. ..... 62/24; 62/36; 62/43

[58] Field of Search ..... 62/24, 36, 43

[56] References Cited

U.S. PATENT DOCUMENTS

| | | | |
|---|---|---|---|
| 3,625,016 | 12/1971 | Hoffman | 62/26 |
| 3,625,027 | 12/1971 | Hoffman | 62/16 |
| 4,203,742 | 5/1980 | Agnihotri | 62/24 |
| 4,451,275 | 5/1984 | Vines et al. | 62/28 |
| 4,453,958 | 6/1984 | Gulsby et al. | 62/28 |
| 4,456,461 | 6/1984 | Perez | 62/28 |
| 4,526,595 | 7/1985 | McNeil | 62/28 |
| 4,609,390 | 9/1986 | Wilson | 62/21 |
| 4,657,571 | 4/1987 | Gazzi | 62/23 |
| 4,675,035 | 6/1987 | Apffel | 62/17 |
| 4,762,543 | 8/1988 | Pantermuehl et al. | 62/28 |
| 4,854,955 | 8/1989 | Campbell et al. | 62/24 |
| 4,861,360 | 8/1989 | Apffel | 62/17 |

*Primary Examiner*—Ronald C. Capossela
*Attorney, Agent, or Firm*—Marcus L. Bates

[57] ABSTRACT

A process for separating nitrogen and hydrocarbons from a mixture of gases by splitting the mixture into a plurality of separate streams and throttling the flow of each stream to achieve a selected variable flow rate therebetween. The plurality of separate streams are individually cooled by exchanging heat with a plurality of different process streams, then the cooled separate streams are combined, cooled by another process stream, and again cooled by expansion. The cooled combined streams then enter a separation column where nitrogen ascends the column and exits as a process stream while hydrocarbon descends the column to a reboiler thereof and exits as several process streams. The reboiler is used for cooling one of the separate streams. The hydrocarbon from the bottom of the column is expanded and used to cool a reflux condenser located inside the column and thereafter cools another of the streams before it is discharged from the process. The nitrogen process stream is used to cool another of the separated streams, and then is discharged from the process. The flow rates are controlled to maintain the throttling of the split streams and the pressure drop across the expansion valves within an optimum range of predetermined values.

16 Claims, 2 Drawing Sheets

HIGH EFFICIENCY NITROGEN REJECTION UNIT

RELATED PATENT APPLICATIONS

This patent application is a continuation in part of my co-pending patent application Ser. No. 07/682,287, filed Apr. 9, 1991 now U.S. Pat. No. 5,141,544 issued Aug. 25, 1992.

BACKGROUND OF THE INVENTION

This invention discloses a novel high efficiency nitrogen rejection unit by which varying amounts of excess nitrogen are removed from a natural gas stream. Transporting pipelines usually accept natural gas containing up to a maximum of four mole percent total inerts. In this disclosure, total inerts are calculated as the sum of carbon dioxide, nitrogen, helium and other non-hydrocarbon gasses. Carbon dioxide is easily removed by various commercial methods, as for example as taught in my co-pending patent application Ser. No. 07/682,287 now U.S. Pat. No. 5,141,544 issued Aug. 25, 1992; and by U.S. Pat. No. 4,762,543. However, nitrogen, helium and argon are not as chemically reactive and, therefore, cannot be removed as easily or generally by the same methods as carbon dioxide. Nitrogen, helium, argon and other atomically light gasses physically act in similar manners at very low temperatures, therefore it will be understood that reference only to nitrogen in the remainder of this description also includes these other gases.

Prior to my co-pending patent application, commercial removal of nitrogen usually was accomplished by fractionation under cryogenic conditions, as seen, for example in U.S. Pat. Nos. 4,451,275, 4,675,035, 4,609,390 and 4,526,595. Present nitrogen extraction methods achieve a high degree of nitrogen purity, but at a high cost in initial plant equipment and refrigeration horsepower. Examples of these and other processes are shown in the accompanying prior art statement.

The nitrogen removal method and apparatus presented herein uses no closed loop external refrigeration equipment and is considerably less expensive than known existing conventional methods. The thermal drive mechanism for the process utilizes a series of Joule-Thomson expansion valves (sometimes hereinafter referred to as a JT valve), the optimum physical placement of cross heat exchangers, and computer-based automatic control of cross heat exchanger loading and temperature monitoring.

SUMMARY OF THE INVENTION

The present invention provides both method and apparatus for separating nitrogen and hydrocarbon vapor from a mixture thereof wherein the mixture enters the system at a relatively high pressure and provides the energy for effecting the separation by the employment of the Joule-Thomson effect to selected process streams.

More specifically, the process, according to the invention, comprises separation of a feed gas that is a mixture of nitrogen and hydrocarbon vapor. The feed gas is split into a plurality of separate streams, each of which is throttled to achieve a selected variable flow rate therebetween. Each of the split streams is cooled by exchanging heat with one of an exiting process stream. The split streams are recombined and again cooled by exchanging heat with another process stream. Then the recombined cooled streams expand to the internal pressure of a nitrogen reject column where the nitrogen and hydrocarbon are separated and exit in separate streams therefrom. Each separated stream is expanded and used for the recited step of cooling the combined streams and also for the recited step of cooling the plurality of streams.

The nitrogen reject column includes a novel internal reflux condenser at the upper end thereof with the lower end thereof terminating in a reboiler. The internal reflux condenser is supported interiorly within the upper end of the column and includes a chamber formed between parallel plate members. A first and second plurality of vertical tubes extend through the plate members. The first plurality of tubes communicate the interior of the tower immediately above and below the plate members and form a condensing surface. The second plurality of vertical tubes extend through the lower plate member and down the column to a vapor trap and forms a one way flow path for liquid.

Accordingly, a primary object of the present invention is the provision of both method and apparatus for the separation of nitrogen and hydrocarbons from a mixture thereof; wherein the thermal drive mechanism for the process utilizes a series of Joule-Thomson expansion valves and the judicious physical placement of cross heat exchangers.

Another object of the present invention is the provision of a system by which a separation process is carried out and wherein nitrogen and hydrocarbons are separated from a mixture thereof while utilizing the pressure drop of the various process streams for the thermal drive of the system.

A further object of this invention is the provision of a system for separating nitrogen and hydrocarbons from a relatively high pressure mixture thereof by splitting the mixture into a plurality of streams, cooling each split stream of the mixture by expansion of various downstream process streams which exchange heat with the split streams, and then effecting a separation in an improved separation column.

A still further object of this invention is the provision of a method of separating nitrogen and hydrocarbons from a high pressure mixture thereof by utilizing the pressure drop of various process streams thereof for the thermal drive of the system and judiciously controlling the various flow rates throughout the process.

Another and still further object of this invention is the provision of a process by which nitrogen is removed from produced compressible fluid object from a wellbore by splitting the compressible fluid into a plurality of streams, cooling each split stream of the mixture by expansion of various downstream process streams which exchange heat with the split streams, and thereafter effecting a separation of the nitrogen from the residual compressible fluid in a separation column.

These and other objects and advantages of the present invention will become readily apparent to those skilled in the art upon reading the following detailed description and claims and by referring to the accompanying drawings.

The above objects are attained in accordance with the present invention by the provision of a method for use with apparatus fabricated in a manner substantially as described herein.

DETAILED DESCRIPTION OF THE DRAWINGS

Figure 1:
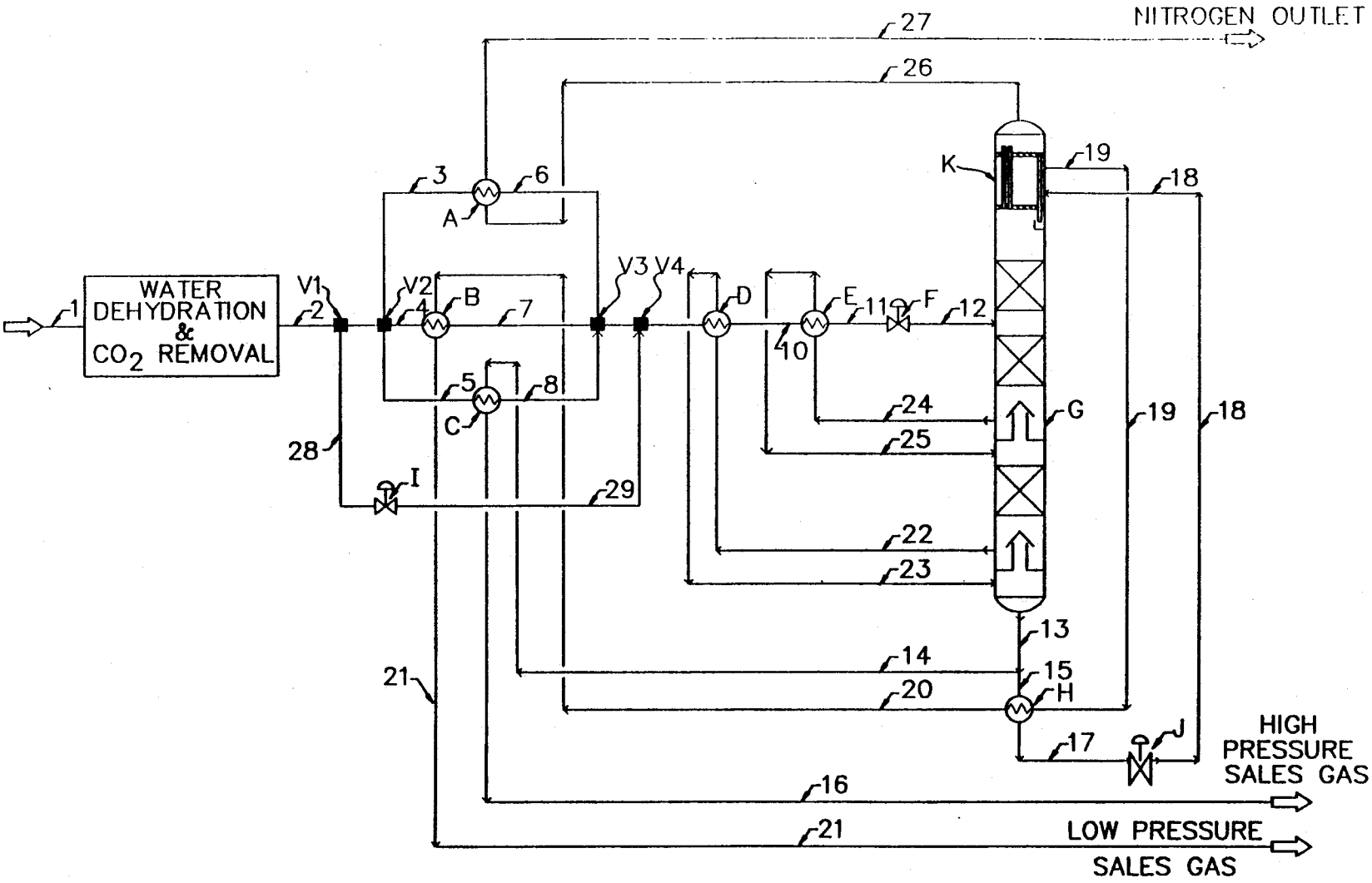
FIG. 1 of the drawing is a diagrammatical representation of a system made in accordance with the present invention for removing nitrogen and hydrocarbons from a mixture thereof.
Figure 3:
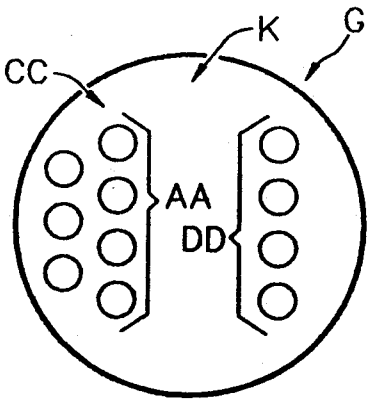

The figures of the drawings disclose apparatus made in accordance with this invention for removal of nitrogen from natural gas streams. As particularly seen diagrammatically illustrated in FIG. 1, a natural gas stream 1 enters a water dehydration and CO2 removal apparatus. A clean, dry mixture of nitrogen and hydrocarbons continues at stream 2, and through a diverter valve device V1. The stream continues to a diverter valve device V2 where the flow is split into three separate, parallel streams 3, 4 and 5. Heat exchangers A, B and C are connected in parallel respective to one another with the downstream side 6, 7 and 8 thereof being recombined at collection point V3. V4 is a second collection point. Heat exchangers D and E are series connected respective to one another and are connected to JT expansion device F.

A nitrogen reject column G includes a novel internal reflux condenser K within the upper end thereof and is made in accordance with the present invention. The lower end of column G terminates in a reboiler, illustrated for convenience as the before mentioned exchanger D. Heat exchanger H is series connected respective to JT expansion device J, with the outlet thereof being connected to the novel condenser K.

Figure 2:
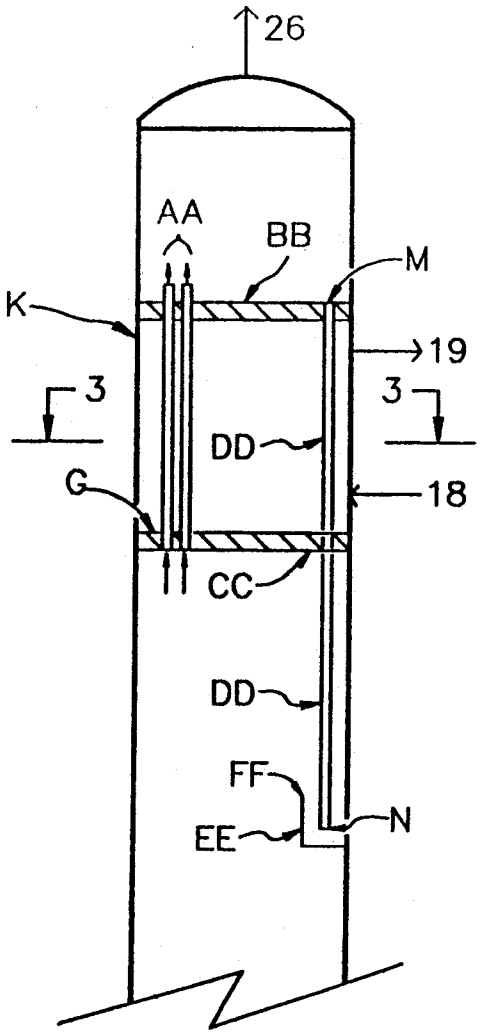
FIG. 2 is an enlarged, broken, diagrammatical representation showing the details of part of the apparatus of FIG. 1; and, FIG. 3 is a cross-sectional view taken along line 3—3 of FIG. 2.

As seen in FIG. 2, the internal reflux condenser K is disclosed diagrammatically in its simplest form. The condenser is supported interiorly within the upper marginal end of the column G and includes a chamber formed between spaced, parallel plate members BB and CC. Hence the interior wall surface of the column and the confronting faces of the plate members form a heat exchanger chamber within which a first and second plurality of vertical tubes AA and BB are exposed. The tubes AA extend through the plate members BB, CC and communicate the interior of the tower immediately below plate CC and with the interior of the tower immediately above plate member BB. The upper ends of the plurality of vertical tubes AA extend a few inches above the plate member BB to trap liquid and in order to provide a low vapor velocity area to facilitate liquid-vapor separation.

A second plurality of vertical tubes DD each have an inlet that lays flush with the upper plate member and an outlet at the lower end thereof that extends well below the lower plate member CC and into a liquid trap EE which is in the form of an upwardly opening container having overflow edge FF. The outlet end of tubes DD is submerged within liquid contained within trap EE.

The nitrogen rejection unit 20 does not produce any toxic or dangerous by products and often the feed stock is received at an elevated pressure so that little energy is consumed in the process.

OPERATION

This invention discloses an original technique for the efficient removal of nitrogen from natural gas streams without requiring rotating equipment or multiple fractionation columns. This technique includes a novel apparatus by which a mixture of nitrogen and hydrocarbons are separated in a new and un-obvious process.

According to this invention, nitrogen may be reduced from over 50 percent to less than 0.5 percent by volume in natural gas streams. The nitrogen reject stream typically has a purity of approximately 95 percent by volume.

Natural gas typically contains carbon dioxide and water vapor naturally occurring from the production reservoir. The water and carbon dioxide must first be removed before introduction into the nitrogen removal unit. This system is represented as stream 1 in FIG. 1. As the carbon dioxide and water are removed using conventional methods, it is represented as stream 2.

Stream 2 is now split into three streams, 3, 4, and 5, which are controlled by computerized flow control techniques. Streams 3 enters heat exchanger A where heat is removed from stream 3 by being absorbed into the nitrogen rich stream 26 explained later in this document. Stream 4 enters heat exchanger B where heat is rejected to a low pressure residue gas stream 20. Stream 5 enters heat exchanger C where heat is removed or absorbed into the high pressure residue stream 14. Streams 1, 2, 3, 4, and 5 are at a pressure between 700 and 1200 PSIA (pounds per square inch absolute) and a temperature between 80 to 120 degrees F.

Streams 6, 7, 8, and 9 exist at between −60 degrees F. and −150 degrees F. and at a pressure only slightly lower than in streams 3, 4, and 5, respectively. Stream 6, 7, and 8 recombine to form stream 9 which enters heat exchanger D where heat is again removed and rejected into stream 22. Stream 9 exits heat exchanger D as stream 10 at between −100 degrees F. and −175 degrees F. Stream 10 enters heat exchanger E where heat is removed in the final heat removal step. Stream 10 exits heat exchanger E as stream 11 between −100 degrees F. and −195 degrees F. Each heat removal step reduces the inlet pressure approximately 5 to 10 PSI each. Therefore, the pressure in stream 11 is approximately 15 to 30 PSI lower than the inlet pressure at 2.

Pressure reduced in valve F reduces the pressure from the inlet 700 to 1200 PSIA to approximately 315 PSIA and exits pressure control valve F as stream 12. This further cools stream 12 due to the JT effect.

Stream 12 enters an intermediate feed stream location on the nitrogen rejection tower G. The nitrogen rejection tower G utilizes an internal reflux condenser labeled K. Stream 12 enters the column G as a two phase fluid that is partly liquid and partly vapor or in some cases, all liquid. The liquid naturally falls by gravity downward inside the tower where the liquid is stripped of nitrogen by contact with the rising vapor generated lower in the column. Approximately 3 theoretical separation stages or trays are located in the column between stream 12 feed and the liquid draw tray where stream 24 exits the tower. Stream 24 enters heat exchanger E where heat is absorbed into stream 24 from stream 10. Temperature in stream 24 is approximately −200 degrees F. to −225 degrees F. and stream 25 is −180 degrees F. to −215 degrees F. Stream 25 reenters the tower G as two phase fluid. The vapor continues up the tower to strip the nitrogen from the falling liquid 12 as mentioned above.

The liquid from stream 25 continues down the tower another approximate six theoretical stages or trays where the nitrogen is stripped by vapor rising up the column as generated in the reboiler, (heat exchanger D). The column liquid is removed from the column G in stream 22 where it enters heat exchanger D and exits as stream 23. This stream 23 is again two phase and is routed back to the lower portion of the column for separation. The temperature of stream 22 is approximately −200 degrees F. to −225 degrees F. and the temperature in stream 23 is approximately −160 degrees F. to −195 degrees F.

Stream 13 is divided into streams 14 and 15. Stream 14 continues to heat exchanger C where heat is absorbed from stream 5. Stream 14 exits as stream 16 at a temperature of 60 to 100 degrees F. and a pressure of approximately 300 PSIA.

Stream 15 continues to heat exchanger H where it is subcooled to approximately −200 degrees F. and exits as stream 17. Stream 17 then enters expansion valve J where the pressure is reduced to near 25 PSIA and at a temperature of approximately −250 degrees F. Stream 18 is then routed to the internal reflux condenser equipment K. The condenser equipment K is utilized to provide the required cooling to the nitrogen reject tower by overhead. This equipment absorbs heat from the tower overhead and condenses hydrocarbon vapor entering the lower part of the condenser K.

Referring to FIG. 2 for details on the internal reflux condenser K, the column vapor enters the lower part or tube sheet of the heat exchanger labeled CC. The vapor continues up the inside of the heat exchanger tubes labeled AA where hydrocarbon condensation occurs on the internal wall of the tube. During low inlet flow operation, the liquid will flow counter current to the vapor flow and gravitate downward where it will fall to the column internals below tube sheet CC.

During higher flows, the liquid hydrocarbon will be condensed and carried upward along with the gas vapor. The condenser tubes are designed to extend 3 to 4 inches beyond the top tube sheet labeled BB. This extension is necessary in order to provide a location below the upper ends of the tubes AA for separation of liquid and vapor.

In addition, a second set of tubes DD is provided and installed flush with the top tube sheet labeled BB. The lower marginal length of tubes DD extend below the lower tube sheet labeled CC. The purpose of tubes DD is to provide a flow path for only condensate liquid to be transferred through the tube sheets BB and CC, as shown. The lower end of tubes DD are installed in a seal pan or liquid trap and is shown as EE on FIG. 2. The liquid trap EE maintains a liquid seal on the lower end of tubes DD to prevent upward liquid flow through tubes DD. The liquid trap EE preferably is upwardly opening as shown, and can overflow the edge FF as required.

Cooling is provided to the reflux condenser equipment K by absorbing heat into stream 18 which enters the lower part of the shell side of equipment K near lower tube sheet CC. Heat is absorbed into this two phase fluid as explained earlier concerning the reflux condenser G.

The fluid in stream 18 exits the reflux condenser K as stream 19. Stream 19 temperature is approximately −200 degrees F. Stream 19 enters heat exchanger H (FIG. 1) where heat is absorbed into stream 19 and exits equipment H as stream 20.

Stream 20 continues to heat exchanger B where heat is absorbed from stream 4. Stream 20 exits exchanger B as stream 21. This stream is the second of two product streams 16, 21 exiting the nitrogen rejection unit at near 15 PSIA and 60 to 100 degrees F. Stream 26 exits the tower G overhead as the nitrogen rich or nitrogen reject stream. Stream 26 is routed to heat exchanger A where heat is absorbed from stream 3. Stream 27 exits the nitrogen rejection unit at approximately 100 degrees F. and near 20 PSIA pressure.

Stream 28 is extracted from stream 2 and is routed to temperature control valve I. Stream 29 exits valve I and is remixed with the main gas flow in stream 9. The purpose of this bypass valve assembly (streams 28, 29, and valve I) is to provide additional heat to the column reboiler exchanger D. The exchanger A, B, and C can lower the temperature of stream 9 to the point that reboiler D is ineffective in adding heat to the column bottom as required. Therefore, a controlled means of adding additional heat to the reboiler D at the column bottom is provided.

I claim:

1. A system for separating nitrogen and hydrocarbon from a mixture thereof, comprising:

means for elevating the pressure of said mixture to provide a feed gas; first, second, and third heat exchangers having a primary side thereof arranged in parallel; feed valve means connecting said feed gas to the primary side of said first, second, and third heat exchangers to split the feed gas into three streams and to throttle the flow of said three streams and thereby achieve a selected flow rate therebetween;

a separator column including a reboiler; a recombined exchanger means having a primary side connected in series with the primary side of said first, second, and third heat exchangers to recombine the three streams and remove heat from the recombined three streams; said recombined exchanger means having a secondary side connected to receive heat from the lower end of the separator column;

a first expansion valve means connecting the primary of said recombined exchanger means to said separator column and reducing the temperature of the fluid flowing therethrough while reducing the pressure to that of the column;

a column bottom heat exchanger having a secondary connected to the secondary of said second heat exchanger, a second expansion valve means, an internal reflux condenser in said column; means connecting the bottom of said separator column to flow through the primary of said column bottom heat exchanger and through the second expansion valve means, and into said internal reflux condenser for cooling said condenser;

a high pressure residue stream connecting the column bottom to the secondary of said third heat exchanger and to a high pressure discharge;

a low pressure residue stream connecting the secondary of said column bottom heat exchanger to a low pressure discharge;

a nitrogen gas outlet; means connecting the top of the separator column to the secondary of said first heat exchanger to thereby cool the fluid flowing through the first heat exchanger, and then to said gas outlet;

and means by which the feed valve means, the expansion valves, and the reflux condenser temperature are adjusted within an optimum range for separating the nitrogen from the mixture.

2. The system of claim 1 wherein the flow rates through the heat exchangers and the expansion valves are controlled to provide an optimum condition for separation of the nitrogen and hydrocarbons by the provision of sensor means to measure the fluid temperatures exiting the first, second and third heat exchangers and control parameters as required to control the expansion valve means; controller means connected to control the flow rate through said first and second heat exchanger and through said expansion valves and thereby select the optimum condition of operation.

3. The system of claim 1 wherein a portion of the feed gas is diverted around the first, second, and third heat exchangers and directly to the reboiler exchanger to adjust the temperature thereof within an optimum range.

4. A process for separating nitrogen and hydrocarbon from a mixture thereof and flowing the separated nitrogen to a nitrogen discharge and flowing the separated hydrocarbon to a hydrocarbon discharge, comprising the steps of:

adjusting the pressure of said mixture to provide a relatively high pressure feed gas respective to the discharge pressure thereof; splitting the feed gas into a plurality of separate streams and throttling the flow of each of said plurality of separate streams to achieve a selected variable flow rate therebetween;

cooling the plurality of separate streams by passing one of said plurality of separate streams through the primary side of one of a plurality of heat exchangers, each of said plurality of heat exchangers having the primary side thereof arranged in parallel respective to one another;

recombining the cooled plurality of separate streams and thereafter passing the recombined streams through the primary of another heat exchanger that is connected in series relationship respective to the primary sides of said plurality of heat exchangers to remove heat therefrom, and flowing the recombined cooled streams through an expansion valve to further lower the temperature thereof, and then flowing the cooled recombined stream into a nitrogen rejection column where the lighter fractions including nitrogen ascend in the nitrogen rejection column while the heavier fractions including hydrocarbon descend in the nitrogen rejection column and flow through a reboiler thereof; said reboiler includes said another heat exchanger;

cooling the hydrocarbon from the nitrogen rejection column bottom by flowing the hydrocarbons through the primary of a residual hydrocarbon exchanger, and flowing the cooled hydrocarbon through a second expansion valve and then into an internal reflux condenser located within said nitrogen rejection column, thereby cooling the internal reflux condenser, and then through the secondary side of the residual hydrocarbon exchanger, through the secondary side of one of said plurality of heat exchangers, and then to the hydrocarbon discharge; and, passing separated nitrogen from the nitrogen rejection column, through the secondary of one of the recited heat exchangers, and to the nitrogen discharge.

5. The process of claim 4 and further including the steps of compressing and cooling the inlet mixture to achieve an inlet stream having about 900 PSI and 100 degrees F.;

said plurality of streams includes a first, second, and third stream, respectively, connected to first, second, and third heat exchanger primaries, respectively; and further including means by which part of the feed flows directly to the recombined stream to thereby maintain the reboiler at an optimum temperature.

6. The process of claim 4 and further including the steps of connecting the reflux condenser outlet of the nitrogen rejection column to the secondary of at least one of the heat exchangers, then to the hydrocarbon discharge.

7. The process of claim 4 and further including the step of using the upper end of the nitrogen rejection column as the internal reflux condenser by placing transverse spaced plate members within the upper marginal end of the interior of the nitrogen rejection column, flowing fluid up through the internal reflux condenser by connecting a first group of tubes between the plate members through which vapors can pass upward therethrough while condensate collects on the upper plate member;

flowing the condensate down through the internal reflux condenser by connecting a second group of tubes between the plate members through which liquid can gravitate downwardly therethrough while vapors cannot pass upward therethrough;

controlling the flow rate of the three split streams to regulate the temperature thereof, the pressure drop across each expansion valve, and the reboiler temperature within a range that optimizes the separation operation.

8. A method of separating nitrogen and hydrocarbon from a mixture thereof wherein said mixture is a high pressure feed gas; and flowing the separated nitrogen to nitrogen discharge outlet means and flowing the separated hydrocarbon to a hydrocarbon discharge means, comprising the steps of:

splitting said feed gas into three streams and throttling the flow of each of said three streams to achieve a selected variable flow rate therebetween; cooling each of the split feed gas streams by passing a first, second, and third stream, respectively, of said three streams through the primary of a first, second, and third heat exchanger, respectively; the primaries of said heat exchangers being arranged in parallel relationship respective to one another; recombining the cooled first, second, and third streams and thereafter passing the recombined stream through a fourth heat exchanger that is in series relationship respective to the primary side of said first, second, and third heat exchangers to remove heat therefrom;

flowing the cooled recombined stream through an expansion valve to cool the recombined stream, and from the expansion valve into a nitrogen rejection column where the lighter fractions, including nitrogen, ascend the nitrogen rejection column while the hydrocarbon fractions descend the nitrogen rejection column and flow through a reboiler thereof;

placing a reflux condenser in the top of said nitrogen rejection column; cooling the separated hydrocarbon flowing from the nitrogen rejection column by passing the hydrocarbon through a second expansion valve that is connected to said reflux condenser;

passing the separated nitrogen flowing from the nitrogen rejection column to said first heat exchanger and then to said nitrogen discharge, and flowing the separated hydrocarbon from the reflux condenser to a secondary of one of the heat exchangers and then to the hydrocarbon discharge.

9. The method of claim 8 and further including the step of controlling the flow rates of the split streams with a computer that modifies the ratio of feed gas routed to each exchanger in response to changing temperature parameters encountered during the normal facility operation.

10. The method of claim 8 and further including the step of controlling the flow rate of the three split streams to regulate the temperature thereof, the pressure drop across each expansion valve, and a reboiler temperature within a range that optimizes the separation operation.

11. The method of claim 8 and further including the step of controlling the flow rate of the three split streams and the temperature of the reboiler by bypassing some of the feed directly to the reboiler.

12. The method of claim 8 and further including the step of using the upper end of the nitrogen rejection column as the internal reflux condenser by placing transverse spaced plate members within the upper marginal end of the interior of the nitrogen rejection column, flowing fluid up through the internal reflux condenser by connecting a first group of tubes between the plate members through which vapors can pass upward therethrough while condensate collects on the upper plate member;

flowing the condensate down through the internal reflux condenser by connecting a second group of tubes between the plate members through which liquid can gravitate downwardly therethrough while vapors cannot pass upward therethrough;

controlling the flow rate of the three split streams to regulate the temperature thereof, the pressure drop across each expansion valve, and the reboiler temperature within a range that optimizes the separation operation.

13. A method of separating nitrogen and hydrocarbon from a mixture thereof and flowing the separated nitrogen and the separated hydrocarbon to separate collection means, comprising the steps of:

splitting a stream of relatively high pressure feed gas into three separate split streams, and throttling the flow of each of said three split streams to achieve a selected variable flow rate therebetween;

cooling each of the split streams by passing each of the streams through a heat exchanger, combining the three cooled split streams and then further cooling the combined three streams by passing the recombined stream through another heat exchanger, expanding the cooled streams into a nitrogen rejection column to further reduce the temperature thereof where the nitrogen and hydrocarbon are then separated and exit in separate streams therefrom;

expanding the separated stream of hydrocarbon from the separation column to reduce the temperature thereof and using the expanded stream of hydrocarbon for cooling an internal reflux condenser located in the nitrogen rejection column; and flowing the stream of hydrocarbon from the condenser and using the stream for the recited step of cooling one of the split streams, and there after flowing the stream of hydrocarbon to a hydrocarbon discharge;

using the expanded separated stream of nitrogen for the recited step of cooling one of the split streams by flowing the stream of nitrogen through the secondary of a heat exchanger having a primary through which one of the split streams flows in heat transfer relationship therewith; and then flowing the stream of nitrogen to a nitrogen discharge;

carrying out the step of cooling one of the split streams by connecting the secondary of the heat exchanger as the reboiler for the scrubber.

14. The method of claim 13 and further including the steps of controlling the flow rates of the split streams with a computer that modifies the amount of feed gas routed to each exchanger in response to changing temperature parameters encountered during the normal facility operation.

15. The method of claim 13 and further including the steps of controlling the flow rate of the three split streams to regulate the temperature thereof, the pressure drop across each expansion valve, and a reboiler temperature within a range that optimizes the separation operation.

16. The method of claim 13 and further including the step of using the upper end of the nitrogen rejection column as the internal reflux condenser by placing transverse spaced plate members within the upper marginal end of the interior of the nitrogen rejection column, flowing fluid up through the internal reflux condenser by connecting a first group of tubes between the plate members through which vapors can pass upward therethrough while condensate collects on the upper plate member;

flowing the condensate down through the internal reflux condenser by connecting a second group of tubes between the plate members through which liquid can gravitate downwardly therethrough while vapors cannot pass upward therethrough;

controlling the flow rate of the three split streams to regulate the temperature thereof, the pressure drop across each expansion valve, and the reboiler temperature within a range that optimizes the separation operation.

* * * * *